United States Patent [19]

Murata et al.

[11] 4,455,937

[45] Jun. 26, 1984

[54] PRINTING DEVICE

[75] Inventors: Minoru Murata; Tsuyoshi Kawanabe, both of Yokohama, Japan

[73] Assignee: Canon Kabushiki Kaisha, Tokyo, Japan

[21] Appl. No.: 459,969

[22] Filed: Jan. 21, 1983

Related U.S. Application Data

[63] Continuation of Ser. No. 253,548, Apr. 13, 1981, abandoned.

[30] Foreign Application Priority Data

Apr. 24, 1980 [JP] Japan ..... 55-55211

[51] Int. Cl.[3] ..... B41J 9/04

[52] U.S. Cl. ..... 101/93.15; 101/93.17; 400/82

[58] Field of Search ..... 101/93.09, 93.15–93.17, 101/93.38–93.40, 93.45, 205, 99, 110, 206; 400/82

[56] References Cited

U.S. PATENT DOCUMENTS

| | | | |
|---|---|---|---|
| 548,357 | 10/1895 | Eddy et al. | 101/205 |
| 631,126 | 8/1889 | Prouty | 101/205 |
| 4,051,942 | 10/1977 | Suzuki et al. | 101/93.16 X |
| 4,250,807 | 2/1981 | Kondo et al. | 101/93.16 X |

OTHER PUBLICATIONS

Publication: Pawletko et al., IBM Tech. disclosure Bulletin, vol. 19, No. 9, Feb. 1977, pp. 3355–3356.

*Primary Examiner*—Edward M. Coven

*Attorney, Agent, or Firm*—Fitzpatrick, Cella, Harper & Scinto

[57] ABSTRACT

A printing device of serial type capable of printing characters and symbols in a plurality of different colors on a recording sheet, which is provided with a plurality of character wheels for different colors supported on one and same rotational shaft, each wheel having its own stand-by position different from the other, and a mechanism for selectively shifting either of the character wheels.

3 Claims, 6 Drawing Figures

PRINTING DEVICE

This is a continuation of application Ser. No. 253,548, filed Apr. 13, 1981, now abandoned.

BACKGROUND OF THE INVENTION

1. Field of the Invention

This invention relates to a serial type printing device to print characters and symbols on a recording sheet by shifting a character wheel (or ring) along the direction of a printing line. More particularly, it is concerned with a printing device capable of performing dichromatic printing using ink rollers of different colors.

2. Description of the Prior Art

There has so far been known a printing device of a type capable of printing characters and symbols on plain paper, such as one installed in an electronic desk top calculator, for example, wherein the character printing is done discretely in black in the case of addition and in red in the case of subtraction for the purpose of distinguishing the printed data. In such dichromatic printing device, however, ink ribbons (or tapes) are used in most cases, which inevitably requires a very large driving implement for the ink ribbons, hence overall dimension of the printing device increases. In addition, there is further necessity for providing a separate driving source for driving the ink ribbons, which disadvantageously increases the electric power consumption of the printing device.

As the measures for minimizing increase in the size of the printing device and the power consumption, there has been proposed an ink roller type printing device, in which an ink-impregnated roller is caused to contact with a character wheel, and, by its associated rotation with wheel, ink is applied onto the type faces arranged on the peripheral surface of the character wheel, after which the character wheel is hit by a hammer or other percussion device to print a character on a recording sheet.

According to this ink roller type printing device, no separate device needs be provided for driving the ink roller, and, moreover, impact force of the hammer can be reduced by making the type faces on the character wheel of an elastic material, whereby the power consumption can be curtailed. However, when the dichromatic printing is to be done by this ink roller type printing device as in the case of the abovementioned ink ribbon type printing device, difficulty is accompanied due to direct application of ink onto the type faces. In addition, an electronic appliance equipped with such ink roller type printing device for dichromatic printing is forced to be in a large size from the standpoint of its design specification.

SUMMARY OF THE INVENTION

The present invention has been made with a view to eliminating the afore-described disadvantages in the known character printing device, and aims at providing an ink roller type printing device of a compact design, low power consumption, and capable of performing the dichromatic printing.

More specifically, it is an object of the present invention to provide a small-sized, handy ink roller type printing device capable of performing the dichromatic printing by providing two character wheels and two ink rollers in rotatable contact with the character wheels, and selectively driving any one of these two character wheels and ink rollers.

DESCRIPTION OF THE PREFERRED EMBODIMENT

In the following, the present invention will be explained with detail in reference to the accompanying drawing.

Figure 1:
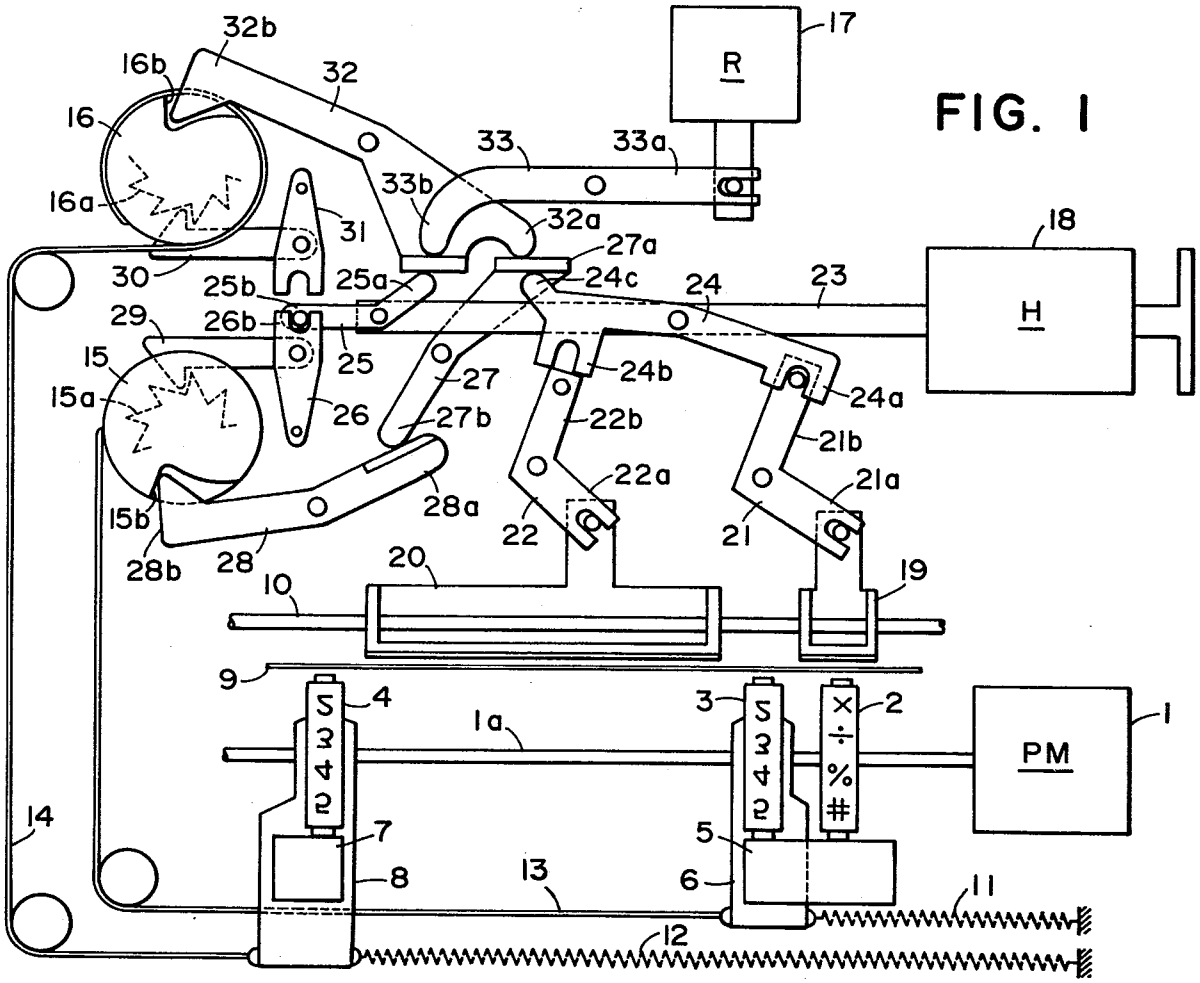
FIG. 1 is a plan view of one embodiment of the printing device with the character wheels in standby state.

FIG. 1 illustrates the main part of the printing device according to the preferred embodiment of the present invention in its standby state. Character wheels 2, 3, 4 are held on a shaft 1*a* extending from a stepping pulse motor 1 and rotated by it, whereby a desired character is selected. Of these three character wheels, the character wheel 2 for symbols (hereinafter abbreviated as "S-ring") is fixedly held on the shaft 1*a* and is positioned opposite to pressing hammer 19 (hereinafter called "first hammer"). On the other hand, the character wheel 3 for black printing (hereinafter abbreviated as "B-ring") and the character wheel 4 for red printing (hereinafter abbreviated as "R-ring") are also held on the shaft 1*a* in a freely slidable manner, any one of which is shifted to a position facing an elongated hammer 20 (hereinafter called "second hammer") for receiving its pressing force. At this stand-by position, a black ink roller 5 is press-contacted to both S-ring 2 and B-ring 3. The ink roller 5 is held on a first carriage 6 in a manner to be rotatable with the character wheels 2, 3 and separated from the S-ring 2 to slide-shift with the B-ring 3 on and along the shaft 1*a* during the printing operation. In the same manner, a red ink roller 7 is press-contacted to the R-ring 4 and rotated therewith. The roller 7 is held on a second carriage 8 along with the R-ring, and slidingly moves on and along the shaft 1*a*.

The carriages 6, 8 are slide-shifted by winding and unwinding ropes 13, 14 for the respective carriages on and from respective take-up drums 15, 16 against and following pulling force of respective return springs 11, 12.

The slide-shifting, i.e., the numerical place changing operation, is done by rotating the take-up drums 15, 16 by a ratchet mechanism to be described later using the driving power of a plunger 18 (hereinafter briefly called "H-plunger") for hammer pressing and numerical place changing.

Further, by a plunger 17 for changing the print color over to red (hereinafter briefly called "R-plunger"), selection is made as to which of the abovementioned take-up drums 15, 16 is to be actuated by the H-plunger 18. In more detail, when the R-plunger 17 is actuated, the driving power of the H-plunger 18 is transmitted to the take-up drum 16 and the carriage 8 is slide-moved by the rope 14, while the R-ring 4 is subjected to pressing force by the second hammer 20 for the red print.

A recording sheet 9 is so guided that it may be fed into a space between the hammers 19, 20 and the character wheels 2, 3, 4.

In the following, explanations will be given as to the sequential steps for printing by the printing device of the above-described construction.

Figure 2:
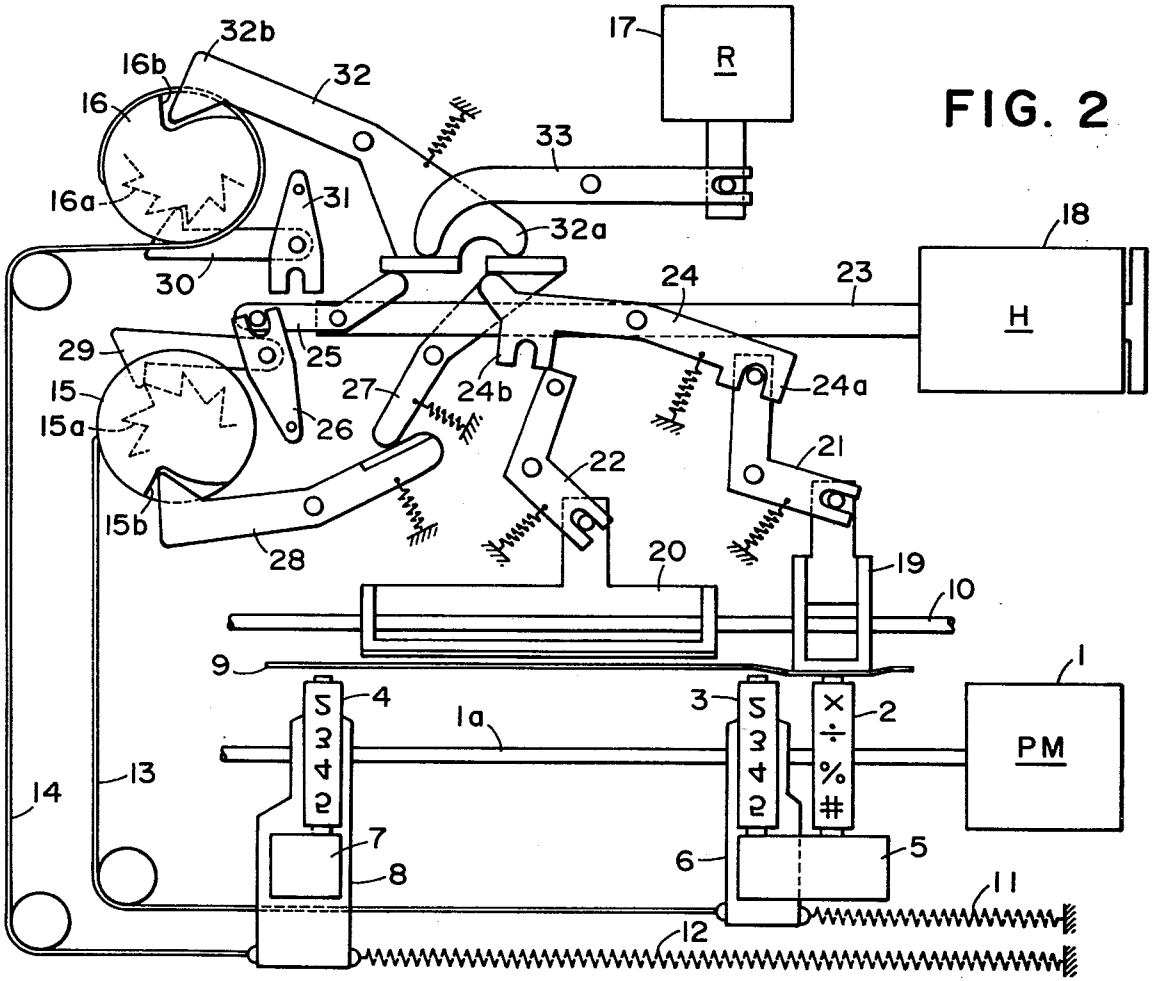
FIG. 2 is a plan view of the printing device with character wheel 2 in its print position.

Referring to FIG. 2 which shows a state of pressing a symbol type face on the S-ring 2 by the hammer 19, the H-plunger 18 is actuated to advance its operating lever 23, on which a see-saw type lever 24 is oscillatably fitted. One end 24*a* of the lever 24 is engaged with one end of a leg of an L-shaped lever 21, whereby the lever 21 oscillates as illustrated in the drawing. By the oscillation of the lever 21, the first hammer 19 engaged with one end of the other leg of the lever oscillates on the pivot of an axle 10, whereby it is pressed against the S-ring 2 with the recording sheet 9 being interposed between the hammer 19 and the S-ring 2. The pressing operation of this hammer 19 will be explained in further reference to FIGS. 3A and 3B showing the side elevations of the same.

Figure 3A:
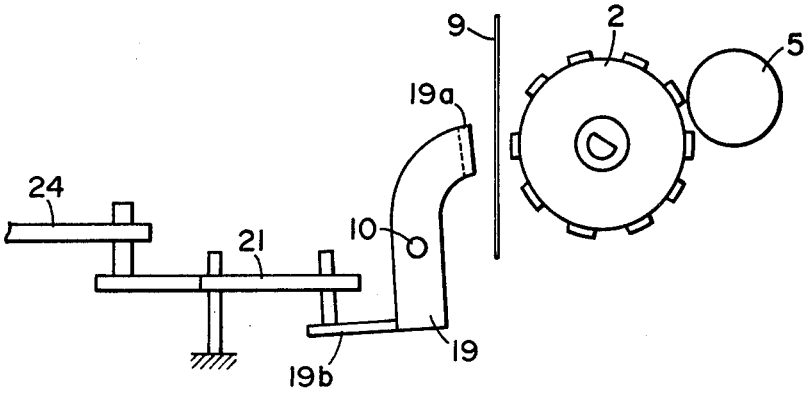
FIG. 3A illustrates a side view of the printing device with character wheel 2 in its FIG. 1 position.
Figure 3B:
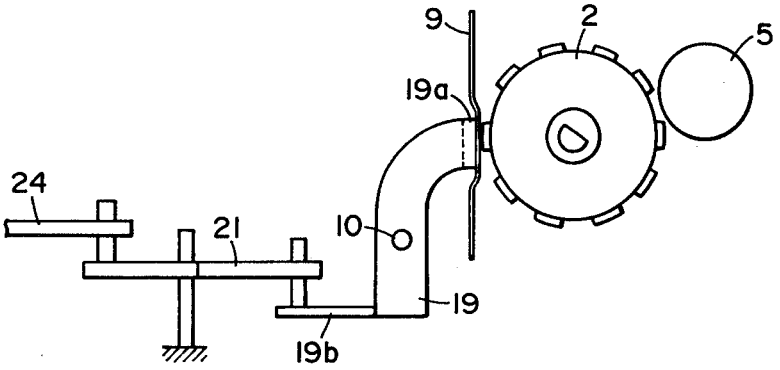
FIG. 3B illustrates a side view of the printing device with character wheel 2 in its FIG. 2 position.

In FIG. 3A, the hammer 19 is in its stand-by state same as that in FIG. 1, wherein the tip end face 19*a* of the hammer 19 is away from the recording sheet 9. In this state, when the L-shaped lever 21 is oscillated by actuation of the H-plunger 18 as shown in FIG. 2, the other end 19*b* of the hammer 19 opposite the tip end face 19*a* is pulled backward as shown in FIG. 3B to oscillate on the pivot of its supporting axle 10, whereby the tip end face 19*a* of the hammer 19 is pressed forward to give impact force against the character wheel, and a character on the S-ring 2 is printed on the recording sheet 9.

Figure 4:
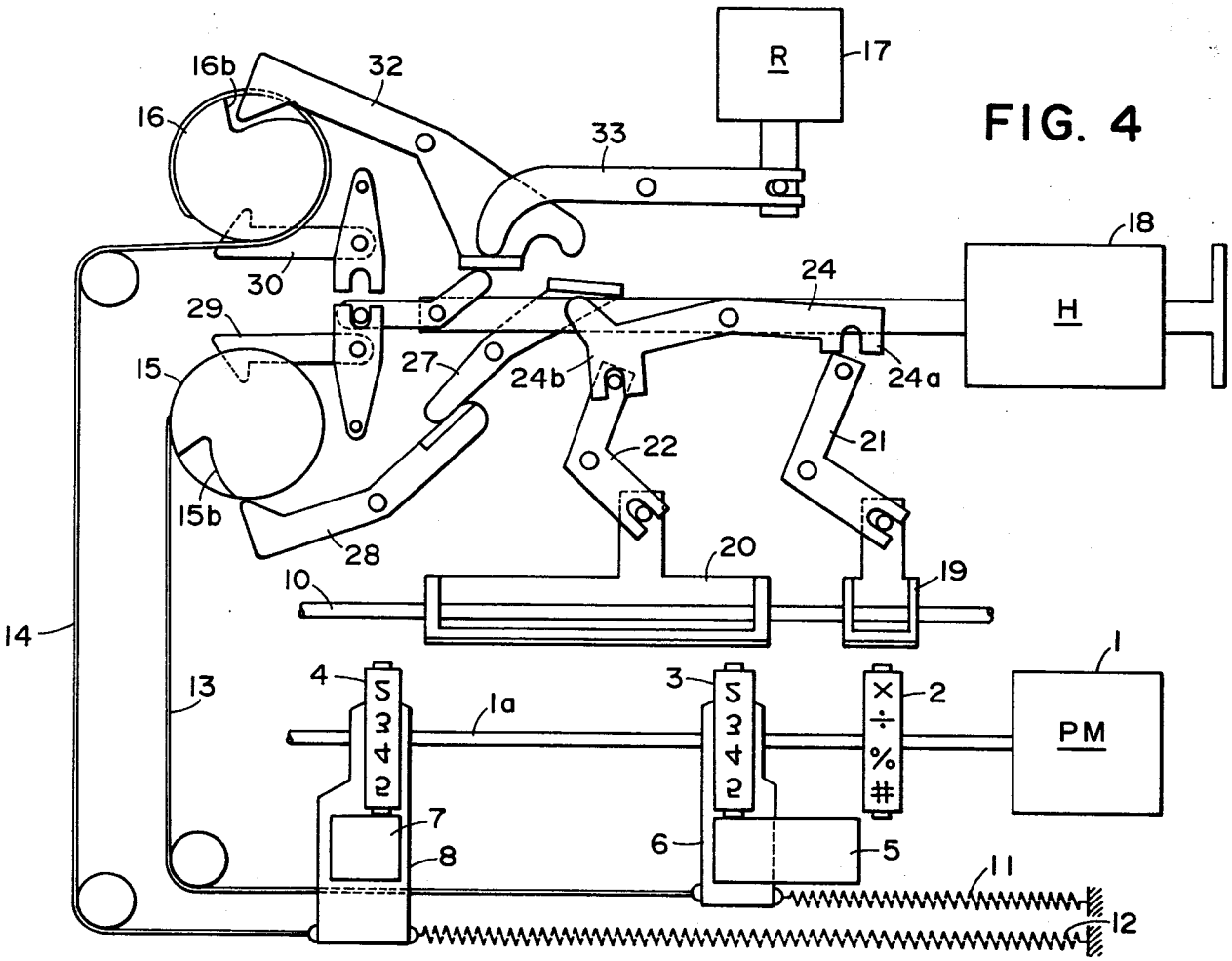
FIG. 4 is a plan view of the printing device with character wheel 3 moved opposite hammer 20.

Simultaneously with the hammer pressing, there takes place a numerical place changing operation, i.e., slide-movement of the carriage, by the ratchet mechanism shown in FIG. 2. In more detail, a see-saw lever 25 is oscillatably fitted at the tip end of the operating lever 23 of the H-plunger 18, and a forwarding lever 29 is in engagement with a ratchet 15*a* integrally rotating with the take-up drum 15 through a lever 26 which is engaged with one leg of the lever 25. As shown in FIG. 2, when the H-plunger 18 is actuated, the pawl of the forwarding lever 29 advances for one tooth of the ratchet 15*a* to be engaged therewith. After this engagement of the pawl with the ratchet, the take-up drum 15 is rotated for one ratchet tooth by the returning force of the H-plunger. In consequence of this, the carriage 6 slidingly shifts for one place through the cord or rope 13 toward the next higher numerical place. FIG. 4 shows the state of the numerical place having been shifted to the next higher place.

In FIG. 4, further rotation of the take-up drum 15 causes a recessed part 15*b* of a cam rotating together with the drum 15 to escape from the tip end of a see-saw lever 28 which has been engaged with it, whereby the lever 28 oscillates, and a see-saw lever 27 engaged with the lever 28 also oscillates. This, in turn, causes the see-saw lever 24 engaged with the lever 27 to oscillate, whereby, different from the state shown in FIG. 1, the other end 24*b* of the lever 24 becomes engaged with an L-shaped lever 22 for the second hammer 20 as shown in FIG. 4.

In the afore-described state in FIG. 4, when the H-plunger 18 is again actuated thereafter, the second hammer 20 is now press-forwarded by the same operation as in FIG. 2, whereby the type face on the B-ring 3 opposite the hammer 20 and which has been brought to one higher numerical place is printed on the recording sheet. By the repeated actuation and release of the H-plunger 18, there can be effected the hammer pressing and place shifting for any required numerical places. Thereafter, the forwarding lever 29 is released by a expedient such as a third plunger (not shown in the drawing), and the carriage 6 (B-ring 3) is returned to its stand-by position as in FIG. 1 by the return spring 11.

Figure 5:
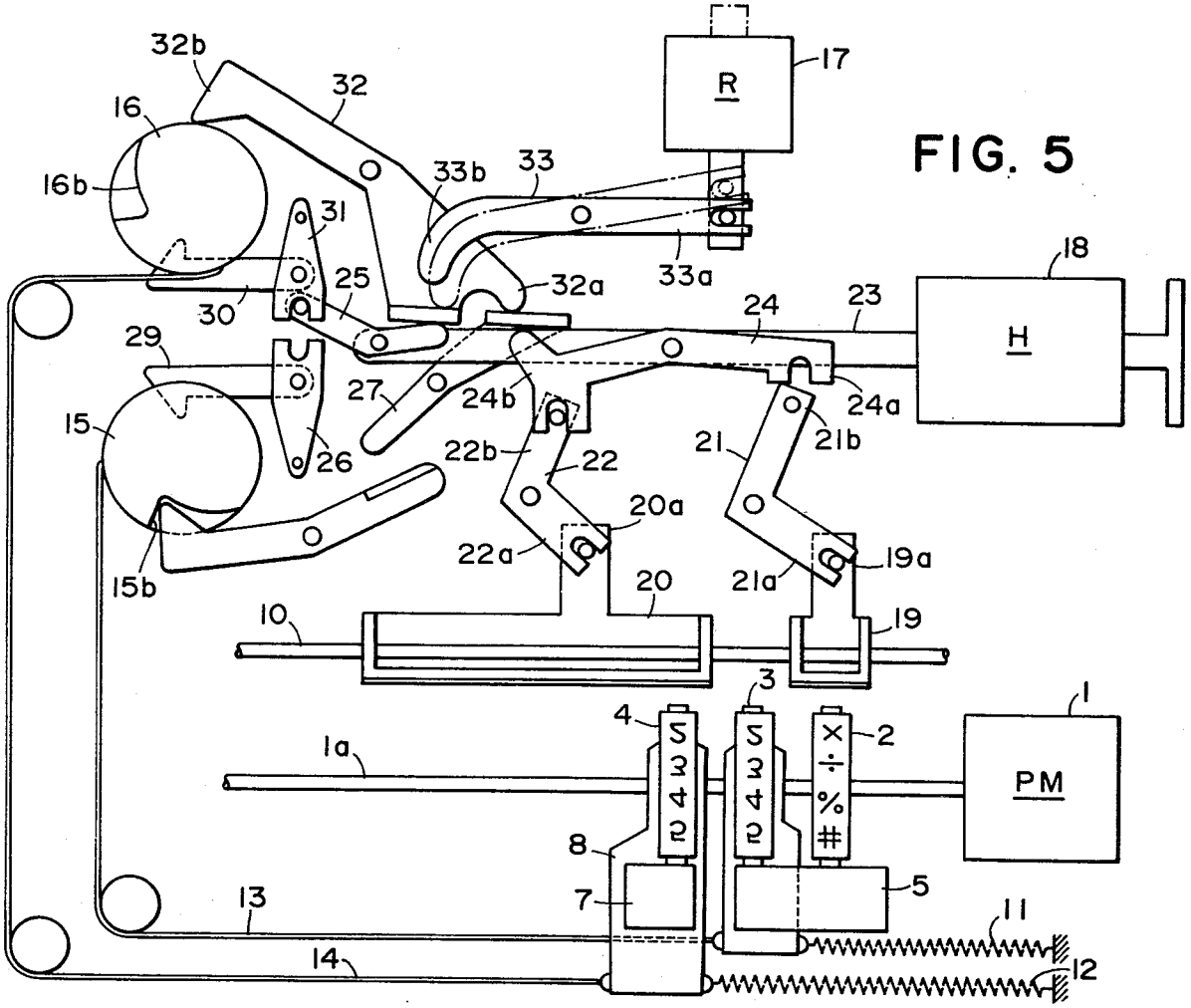
FIG. 5 is a plan view of the printing device with character wheel 4 moved opposite hammer 20.

Referring now to FIG. 5, the printing of numerals in red will be explained. First of all, when the R-plunger 17 is actuated, a see-saw lever 33 engaged with the plunger at its one end is oscillated to press at its opposite end a see-saw lever 32 as indicated by a dot-and-dash line in FIG. 5, whereby, unlike the state shown in FIG. 1, the tip end of the see-saw lever 25 on the plunging lever 23 is now engaged with a lever 31. By this engagement of the lever 25 with the lever 31, the driving force of the H-plunger 18 causes the second take-up drum 16 to rotate through the second forwarding lever 30.

As soon as the second take-up drum 16 rotates, a recessed part 16*b* of a cam rotating with the drum 16 escapes from engagement with the tip end 32*b* of the see-saw lever 32 to oscillate the same. Even after the see-saw lever 33 engaged with the R-plunger 17 returns to its original position in solid line in FIG. 5, the levers 24, 25 are maintained in their engaged state of FIG. 5. Accordingly, the driving power of the H-plunger 18 is transmitted to the second hammer 20 through the opposite end 24*b* of the lever 23 and the lever 22, as is the case with the printing of numerals in black.

It should be noted here that, if the forwarding lever 30 is so constructed that it may further be released on actuation of the R-plunger (this state is not shown in the drawing), the take-up lever 16 is released, and the carriage 8 is returned to a position of a predetermined lowest place as shown in FIG. 5 under force of the spring 12.

As stated in the foregoing, the driving power of the H-plunger 18 has already been changed over for transmission to the forwarding lever 20 and the take-up drum 16. Accordingly, when the H-plunger 18 is actuated thereafter, the type face on the R-ring 4 held on the second carriage 8 is now printed on the recording sheet 9 by the pressing of the second hammer 20 as is the case with FIG. 4. At this instant, the B-ring 3 remains at its predetermined position outside the operating range of the second hammer 20 hence no printing is effected subsequently, the R-ring 4 slidingly shifts to a higher place step by step through the take-up drum 16 which is operated by actuation and release of the H-plunger 18 to effect the red printing for required number of places, as is the case with the black printing by the B-ring 4 which slides through the drum 15 as in FIG. 4.

Thus, as soon as the R-ring 4 shifts to the highest place, the recessed part 16*b* of the cam rotating with the take-up drum 16 returns again to the position of the tip end 32*b* of the see-saw lever 32 to receive therein the oscillating tip end of the lever 32, whereby both see-saw levers 24, 25 also return to their original positions to resume the stand-by state as shown in FIG. 1.

In the above-described manner, the transmission path for the driving power of the H-plunger 18 is changed over by the R-plunger 17 to cause either of the B-ring 3 or the R-ring 4 to be selectively shifted. The R-plunger 17 may be smaller in size and less consumptive of electric power than the H-plunger 18, since it suffices to operate for changing over the levers.

As stated in the foregoing, the present invention makes it possible that, in the serial type character printing device wherein a character wheel is slidingly shifted back and forth in the direction of the numerical place, two different colors can be selectively printed by means of a simple construction of providing a couple of character wheels, other than the symbol ring, in correspondence to ink rollers in these different colors, and a change-over mechanism to selectively shift either of the character wheels.

As the result, it becomes possible to eliminate various disadvantages inherent in the dichromatic printing by the conventional ink ribbon system which is liable to increase dimension of the device due to incorporation therein of a mechanism to drive the ink ribbon, and to increase power consumption for necessity of increasing the impact force of the hammer to enable the type face on the character wheel to be pressed by it through the recording sheet as well as the ink ribbon. Further, a single character wheel alone is subjected to shifting, which contributes to reduction in size of the driving source for the shifting.

What we claim is:

1. A serial printing device, comprising:

a first type wheel provided on a rotatable shaft and having a standby-position which is near a first end of the shaft, said first type wheel being adapted to be applied with a first color ink;

a second type wheel provided on the shaft and having a standby-position which is near a second end of the shaft so that the standby-position of said second character wheel is different than the standby-position of said first character wheel, said second type wheel being adapted to be applied with a second color ink;

a solenoid connected to transmitting means for selectively driving along the shaft said first and said second type wheels;

means for shifting the transmitting means to selectively apply the driving power of said solenoid to one of said first and second type wheels so that the selected type wheel is driven and the non-selected type wheel remains in its standby-position; and first and second spring means connected to said first and second type wheels, respectively, for moving said first and second type wheels in cooperation with the transmitting means.

2. A serial printing device according to claim 1, wherein said first color ink is black, and said second color ink is red.

3. A serial printing device according to claim 1, wherein a third type wheel is provided on the shaft at a position outside of the movement path of said first and second type wheels.

* * * * *